United States Patent [19]

Wells

[11] 4,360,814

[45] Nov. 23, 1982

[54] ANTENNA LOADING DEVICE WITH SERIES CONNECTED LOADING COILS

[76] Inventor: Donald H. Wells, 7127 Kipling, Holland, Ohio 43528

[21] Appl. No.: 95,219

[22] Filed: Nov. 19, 1979

[51] Int. Cl.[3] ..... H01Q 9/00

[52] U.S. Cl. ..... 343/750; 343/715

[58] Field of Search ..... 343/750, 749, 752, 746, 343/747, 745, 900, 861, 713, 715

[56] References Cited

U.S. PATENT DOCUMENTS 2,636,122 4/1953 Hayes ..... 343/750
4,080,604 3/1978 Wosniewski ..... 343/750

FOREIGN PATENT DOCUMENTS 298990 10/1927 United Kingdom .
391749 7/1930 United Kingdom .
820291 10/1957 United Kingdom .
1263027 2/1972 United Kingdom .

*Primary Examiner*—David K. Moore
*Attorney, Agent, or Firm*—William Preston Hickey

[57] ABSTRACT

A trimming device for a whip antenna, and the like, wherein two coaxial coils are connected in series with each other and with the antenna whip; and a tuning ring is positioned in the combined external magnetic field of both coils. The tuning ring, being in the external field, has an annular flow of electricity induced therein which in turn produces a magnetic field which opposes that of the coils. In the preferred arrangement, an insulating spacer sheet is wrapped over the inside coil, and the outside coil is wound tightly over the spacer sheet to provide a predetermined amount of intercapacitance between the coils, which can be changed by changing the thickness of the spacer sheet.

17 Claims, 4 Drawing Figures

ANTENNA LOADING DEVICE WITH SERIES CONNECTED LOADING COILS

TECHNICAL FIELD

The present invention relates to inductance loading devices, and more particularly to loading devices for changing the electrical length of RF antennas.

BACKGOUND OF THE INVENTION

A problem exists, for example, with quarter wave length antennas that are installed on vehicles, by reason of the fact that the surrounding metal structure has a pronounced capacitive effect which can drastically change the antenna's frequency from that of its uninstalled condition. With quarter wave length antennas, a quarter wave of each oscillation must occur in the transmission line or structure to which the antenna is electrically connected. In addition, metal structures close to the antenna produce a capactive effect on the antenna to change its tuned frequency. A need therefore exists for a simple way of tuning the antenna after it is installed.

I am aware of the Wosniewski U.S. Pat. No. 4,080,604, which utilizes a grounded ring around a coil, and the position of which ring is adjustable to change the capacitance of the coil. I am also aware of the Ireland U.S. Pat. No. 3,474,453 which utilizes a capacitive ring around a coil which ring is connected to the antenna side of the coil. Such devices are inefficient by reason of large $I^2R$ losses.

An object of the present invention is the provision of a new and improved inductance loading device for antennas and the like, which has low $I^2R$ losses and which maintains its Q value as the inductance of the device is changed to shift its band pass.

Another object of the invention is the provision of a new and improved inductance loading device having a controlled amount of intercapacitance to provide a series tuned circuit, the tuned frequency of which shifts in the same direction as does its loading of an antenna; and whereby its efficientcy as a series tuned circuit is maintained as it changes the band pass of an antenna connected thereto.

Another object of the invention is the provision of a loading device of the above described type having a coil wound over another coil, and the capacitance of which is changed at manufacture by changing the thickness of a spacer between the coils—thus permitting one design of inductance coil to be used to load antennas that are efficient over a great range of RF frequencies.

DESCRIPTION OF THE PREFERRED EMBODIMENTS

Figure 1:
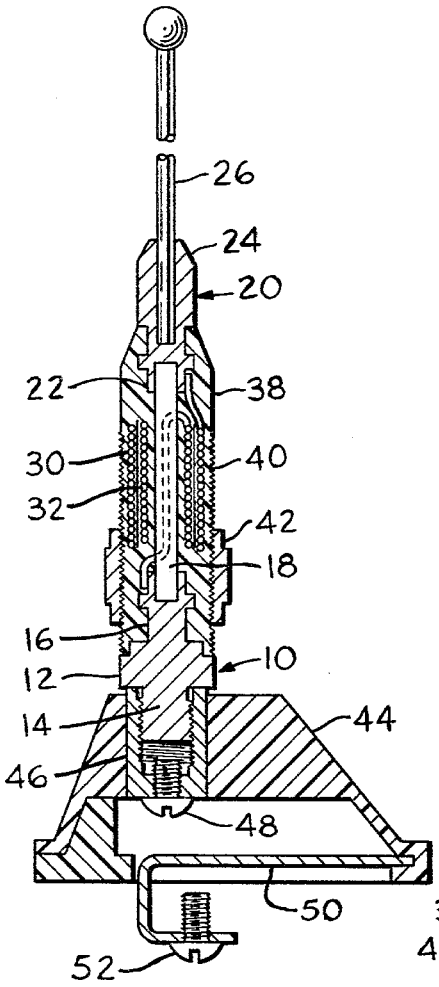
FIG. 1 is a longitudinal sectional view of a loading device embodying principles of the present invention.

Although the tuning device shown in the drawing has other uses, it is shown as embodied in a support for a quarter wave length antenna. The device generally comprises a base terminal 10 having a centrally located flange 12, a lower threaded support end 14, and an upper generally tubular end 16 for receiving a fiberglass insulator rod 18. The tubular end 16 is crimped onto the lower end of the insulator rod 18, and an antenna rod support terminal 20 is crimped onto the upper end of the insulator rod 18. The antenna rod support 20 has a lower tubular end 22 that can be crimped and an upper tubular end 24 sufficiently rigid to support the antenna rod 26. The upper end 24 has a threaded opening 28 through its sidewall to receive a set screw not shown for holding the antenna rod therein. The base terminal 10 and the antenna rod support terminal 20 are the input and output terminals of the tuning device, and are electrically connected by an impedance coil 30. Flow of electricity through the coil 30 produces a magnetic field that is generally toroidal shaped. In order to amplify this field, for reasons which will later be explained, another coil 32 is positioned inside of the coil 30 and the two coils are connected in series in such a way that their fields add. In the embodiment shown, a wire 34 is soldered to the base terminal 10 and extends up through the center of the coil 32 to the top of the coil 32. The bottom of the coils 30 and 32 are connected together and the top of the coil 30 is soldered to the antenna rod support terminal 20. An insulator sleeve 36 having high dielectric properties is positioned between the coils 30 and 32. The coils are made from a single wire that is coiled on a suitable form to make the coil 32, the sleeve 36 of appropriate thickness is wrapped around the coil 32, and the coil 30 is wound back over the sleeve 36. Both coils are wound therefore in the same direction and their magnetic fields add to each other.

An insulating plastic 38 is injection molded over, in and around, the coils between the terminals 10 and 20 to hermetically seal the coils and rigidly connect the terminals 10 and 20. Threads 40 are moled in the external surface of the plastic 38 and an annular internally threaded tuning ring 42 is threaded onto the threads 40 for positioning the ring 42 longitudinally of the toroidal shaped magnetic field. It will be seen that the lines of force at the lower end of the toroidal shaped magnetic field extend generally perpendicularly to the ring 42 so that as the ring is moved up into the field, more and more lines of force become intercepted by the ring. These lines of force produce a circular flow of electricity around the ring, generally normal to the coils to thereby produce a counter magnetic field which opposes the flux produced by the coils 30 and 32. It will be seen that electrical flows axially of the ring would not produce a counter field opposing that of the coils. The counter field produced by the ring 42 in effect reduces the inductance of the coils 30 and 32 and therefore decreases the electrical length of the antenna as the ring 42 is moved into the toroidal shaped field produced by the coils 30 and 32.

It will further be seen that the coils 30 and 32 produce a capacitive effect therebetween which is in series circuit with their inductance and that the strength of the capacitive effect is set by the thickness of the sleeve 36. During manufacture therefore the amount of the capacitive effect can be tailored to a particular application by using sleeves 36 of the desired thickness. It will also be seen that the tuning ring 42 is electrically isolated from ground and from the RF transmitting circuit of which the coils are a part. Because the ring 42 is spaced much further away from the coil 30 than is coil 32, and because the ring 42 is most effective when it intercepts the external lines of force that are normal to the coils, its positioning has very little effect on the capacitance of the series tuned circuit.

While the base terminal 10 can be supported in any manner, it is shown in FIG. 1 as supported by the plastic inverted cup 44 shown and described in my earlier application Ser. No. 831,880 and now abandoned. The plastic cup 44 has a threaded metal insert 46 into which the base terminal 10 is screwed and the bottom of which contains a machine screw 48 for securing a transmission line, not shown, thereto. The bottom of the cup has an internal recess into which one leg of a U-shaped retainer 50 is received. The other leg of the U-shaped retainer 50 is provided with a set screw 52 that can be tightened down onto the edge of support structure received between the opposing legs of the retainer 50.

The device will usually be used by designing the coils 30 and 32 for use with a certain length of antenna rod 26 for a particular band of RF frequencies. In a preferred embodiment, the inductance can be changed by the ring 42 over a range of frequencies approximately four times that of the RF band for which the device is to be used. Before installation, the ring 42 will be positioned so that it enters the toroidal field by an amount increasing the tuned frequency by one band width. After installation, surrounding metal structures will lower the tuned frequency because of their capacitive effect on the antenna, and the antenna will be tuned by threading the ring 42 upwardly to decrease the inductance produced by the coils 30 and 32 and bring the circuit into resonance at the center frequency of the desired band of frequencies.

Since the capacitive effect of surrounding structures can be appreciable, the preinstallation position of the ring will preferably be such that it can be moved upwardly by an amount increasing the frequency by twice the band width, and downwardly by an amount decreasing the frequency by one band width. It will also be seen that the device is capable of doing this with great efficientcy, and low $I^2R$ losses, since the electrical flow in the ring is substantially normal to the coils 30 and 32 to thereby produce a field which efficiently opposes that of the coils.

Figure 4:
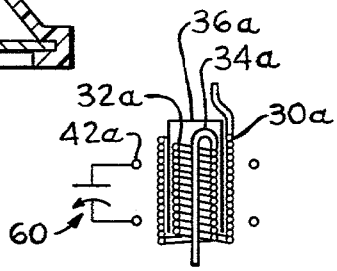
FIG. 4 is a schematic view of another embodiment of the invention.
Figure 2:
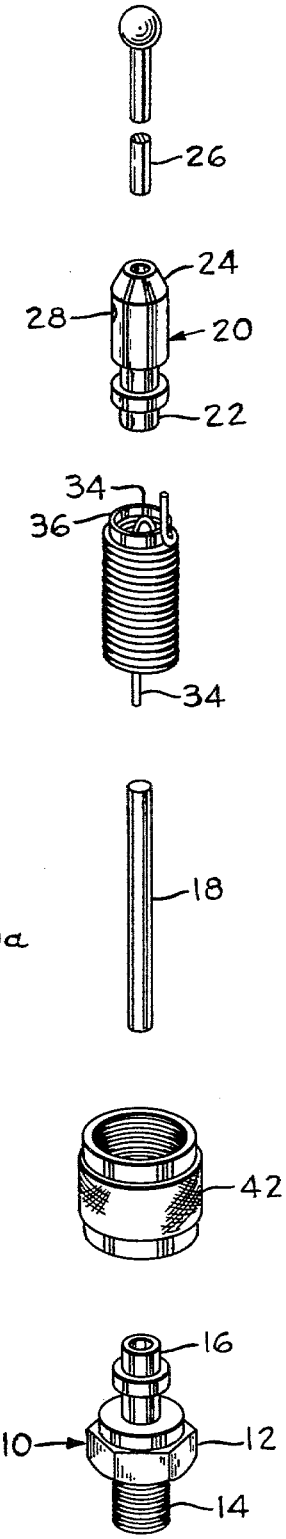
FIG. 2 is an exploded view of the device shown in FIG. 1.
Figure 3:
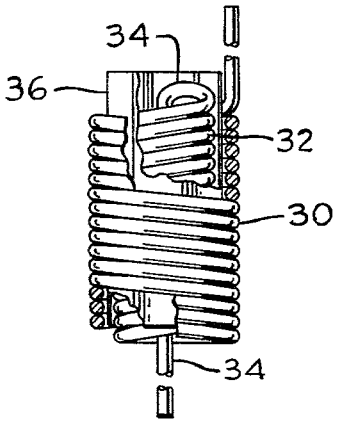
FIG. 3 is a side elevational view with portions broken away of the impedance producing coil shown in FIGS. 1 and 2.

The embodiment shown in FIG. 4 is generally similar to that previously described excepting that the tuning ring is a coil of conductive material the ends of which extend remotely to a variable reactance device 60. Those portions of the embodiment shown in FIG. 4 which correspond to similar portions shown in FIGS. 1–3 are designated by a like reference numeral characterized further in that a suffix is affixed thereto. The embodiment shown in FIG. 4 will have particular utility in remotely changing the tuning of TV antennas and the like.

While the invention has been described in considerable detail, I do not wish to be limited to the particular embodiments shown and described, and it is my intention to cover hereby all adaptations, modifications, and arrangements thereof which come within the practice of those skilled in the art to which the invention relates, and which fall within the purview of the following claims.

I claim:

1. A variable mutual transductance tuned circuit, and the like, comprising: a first helically wound coil, a second helically wound coil positioned coaxially inside of said first coil, first and second terminal elements, means seried connecting said coils to each other and to said first and second terminal elements in an electrically conductive arrangement so that the magnetic fields of both of said coils are common, are generally in phase, and add at resonance; an electrically conductive inductance producing tuning member positioned in the field of both of said coils and isolated from ground so that electrical flow therein produces a magnetic field which interacts with the magnetic field of both said coils; and means for changing the inductive interactance of said member to the combined magnetic field of said coils.

2. The circuit of claim 1 wherein said coils are both wound in the same rotational direction.

3. The circuit of claim 2 wherein said means for changing the inductive interactance of said member, positions said ring longitudinally of said coils.

4. The circuit of claim 3 wherein said member is external of said coils.

5. The circuit of claim 1 including a generally tubular spacer element between said coils, said spacer element being tight to said inner coil and said outer coil being tight to said spacer element.

6. The circuit of claim 5 wherein said generally tubular spacer element is of a high dielectric material and whereby the thickness of said spacer element sets the mutual capacitance between said coils.

7. The circuit of claim 1 wherein said second coil helically advances from adjacent said second terminal towards said first, and then forms said first coil by helically advancing back over the top of said second coil.

8. An antenna trimming device, comprising: a base terminal, an electrically conductive antenna rod support spaced axially from said base terminal, an inner axially extending coil positioned generally between said base terminal and said antenna rod support, an outer axially extending coil generally surrounding said inner coil, said coils being connected in series to each other and to said base terminal and antenna rod support in an electrically conductive arrangement so that the magnetic field of both said coils are common, are generally in phase, and add at resonance, an inductance producing tuning member transversely positioned in the magnetic field of both said coils and isolated from ground to product an inductance which interacts with the force of said magnetic field, and means for varying the interactance of said inductance producing tuning member with said magnetic field.

9. The antenna trimming device of claim 8 wherein said last mentioned means is constructed and arranged for positioning said member longitudinally of said coils.

10. The antenna trimming device of claim 8 wherein said last mentioned means is constructed and arranged to vary the resistance to current flow in said tuning member.

11. The antenna trimming device of claim 8 wherein said coils are formed by a wire running from said base terminal to the opposite end of said inner coil with the turns of the inner coil running back toward said base terminal, and with subsequent turns of said wire proceeding back to said opposite end of said inner coil outwardly over the top of said inner coil to form said outer coil.

12. The antenna trimming device of claim 11 with an insulator sleeve between said inner and outer coils and constructed and arranged to control the intercapacitance between said inner and outer coils.

13. An antenna trimming device, comprising: a base terminal, an electrically conductive antenna rod support spaced axially from said base terminal, an inner axially extending coil positioned generally between said base terminal and said antenna rod support, an outer axially extending coil generally surrounding said inner coil, said coils being connected in series to each other and to said base terminal and antenna rod support in an electrically conductive arrangement such that the magnetic fields of both said coils are common, are generally in phase, and add at resonance, and an inductance producing trimming device positioned externally of said outer coil and isolated from ground so that its field interacts with said magnetic fields of both said inner and outer coils, and means for varying the inductive interactance of said tuning member with said magnetic field of said coils to vary the oscillating frequency of the structure to which the device is connected.

14. The antenna trimming device of claim 13 including a spacer of high dielectric material separating said inner and outer coils to control the intercapacitance of said coils.

15. The antenna trimming device of claim 13 wherein said trimming device is an annular electrically conductive ring.

16. The antenna trimming device of claim 15 including a sleeve of high dielectric material positioned on said inner coil and over which said outer coil is wound.

17. The device of claim 1 including a body of plastic encasing and hermetically sealing said coils, said body of plastic having external threads thereon extending longitudinally of said coils, and said tuning member being a ring having threads which engage said external threads on said plastic for threading said ring longitudinally of said coils.

* * * * *